United States Patent [19]

Shell et al.

[11] 4,024,050

[45] May 17, 1977

[54] PHOSPHOROUS ESTER ANTIFOULANTS IN CRUDE OIL REFINING

[75] Inventors: Don C. Shell, Richmond; Edward C. Hayward, Houston, both of Tex.

[73] Assignee: Nalco Chemical Company, Oak Brook, Ill.

[22] Filed: Oct. 23, 1975

[21] Appl. No.: 625,173

Related U.S. Application Data

[63] Continuation-in-part of Ser. No. 539,227, Jan. 7, 1975, abandoned.

[52] U.S. Cl. ..... 208/48 AA; 203/6; 203/7; 203/8; 203/50; 208/348; 252/400 A; 260/666.5

[51] Int. Cl.[2] ..... C10G 9/16; C10L 1/26; C23F 14/02; B01D 3/34

[58] Field of Search ..... 208/48 AA, 348; 203/6, 203/7, 8, 50; 44/72, 76; 252/400 A

[56] References Cited

UNITED STATES PATENTS

| | | | |
|---|---|---|---|
| 2,899,387 | 8/1959 | Fierce et al. | 208/348 |
| 3,017,357 | 1/1962 | Cyba | 252/32.5 |
| 3,261,774 | 7/1966 | Newkirk et al. | 208/48 |
| 3,516,922 | 6/1970 | Anzilotti | 208/47 |
| 3,558,470 | 1/1971 | Gillespie et al. | 208/48 |
| 3,645,886 | 2/1972 | Gillespie et al. | 208/48 |

*Primary Examiner*—Delbert E. Gantz
*Assistant Examiner*—G. E. Schmitkons
*Attorney, Agent, or Firm*—Hill, Gross, Simpson, Van Santen, Steadman, Chiara & Simpson

[57] ABSTRACT

Phosphate and phosphite mono- and di-esters in small amounts function as antifoulant additives in crude oil systems employed as feedstocks in petroleum refining which are subjected to elevated temperatures of from about 100° to 1500° F. and which are prone to produce material that deposits and accumulates upon the surfaces of petroleum processing equipment, such as heat transfer equipment and the like. Such additives not only inhibit and suppress fouling but also reduce fouling in previously fouled refining systems.

11 Claims, No Drawings

PHOSPHOROUS ESTER ANTIFOULANTS IN CRUDE OIL REFINING

RELATED APPLICATION

This is a continuation-in-part application of our earlier filed U.S. application Ser. No. 539.227, filed Jan. 7, 1975 and now abandoned.

BACKGROUND OF THE INVENTION

In petroleum refining, the crude oil systems employed as feedstocks are prone to produce material that deposits and accumulates upon the surfaces of heat transfer equipment contacted therewith resulting in the fouling of petroleum process equipment. In normal, continuous use, for example, the heat exchangers used in almost all crude oil unit processes suffer gradually increasing losses in efficency, heat transfer, and throughput owing to deposition of material on the inner surfaces thereof. Consequently, crude oil process units must be periodically shut down and deposits removed or the units replaced. Such fouling of heat exchangers, and also such equipment as furnaces, pipes, reboilers, condensers, compressors, auxiliary equipment, and the like, is costly by reason of the loss of production time and the man hours required for disassembly, cleaning and reassembly of unit process equipment components. The equipment is usually fabricated of carbon steel, stainless steel, or aluminum.

The fouling is generally attributed to the presence of unstable components, such as oxidized derivatives of hydrocarbons, the inorganic impurities present in hydrocarbon fractions, the presence of olefinic unsaturated hydrocarbons or their polymeric derivatives, or the like. Thus, almost all crude oil and fractions thereof, as well as process cuts prepared from such, contain minor amounts of readily oxidized and oxidizable hyrdocarbon constituents. Furthermore, almost all crude oil contains small amounts of dissolved oxygen, sulfur and metals, in a free and/or chemically combined state. If chemical and/or thermol treatment is involved, the olefinic substitutes may be polymerized.

The use of certain organophosphorous compounds as antifoulant additives to mineral hydrocarbon mixtures employed as refinery feedstocks has heretofore been proposed. Thus, Newkirk, and Miller in U.S. Pat. No. 3,261,774 teach the addition of various N-alklyl amidophosphoric acids as antifoulants, and Gillespie and Ryer in U.S. Pat. No. 3,558,470 teach the addition of mixtures of (I) organophosphite esters and (II) a condensation product of mono-, or di, carboxylic acid or anhydride thereof with a polyalkylene polyamine or the reaction product of I with II. Gillespie et al never use only phosphite esters as additives.

So far as known to us, no one has heretofore ever employed only mono and di phosphate or phosphite esters and amine salts thereof as antifoulant additives in crude oil materials. Such phosphorous esters, and amine salts thereof, have now been found characteristically to display surprising and very useful antifoulant activity in crude oil materials. Not only do these materials inhibit and suppress and even prevent, fouling when in crude oil materials, but also they unexpectedly appear to reduce the fouling in previously used and fouled crude oil refinery processing quipment. Such additives in combination can be considered to be arguable synergistic in some of these effects, and applications, as those skilled in the art will appreciate. The art of reducing fouling in refining streams is very complex and the reasons why a particular antifoulant system works to reduce fouling effectively in some mineral hydrocarbon mixtures, but perhaps not in others, are not now known.

BRIEF SUMMARY OF THE INVENTION

In one aspect, this invention relates to an improved process for reducing the fouling tendencies of crude oil materials during normal and conventional petroleum refining operations thereof of the type using elevated temperatures ranging from about 100 ° to 1500° F.

This process involves the step of mixing with a crude oil material a small amount of mono or di phosphate ester and/or phosphite ester. The phosphate ester compounds employed in this invention are characterized by the general formula:

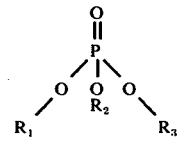

(2)

where:

$R_1$, $R_2$, and $R_3$ are each individually selected from the group consisting of hydrogen, addition complexes of hydrogen with amines, alkyl, aryl, alkaryl and cycloalkyl, alkenyl, and aralkyl, and provided that in any given such phosphate ester at least one and not more than two of each of $R_1$, $R_2$, and $R_3$ are hydrogen or an addition complex of hydrogen with an amine.

The phosphite ester compounds employed in this invention are characterized by the general formula:

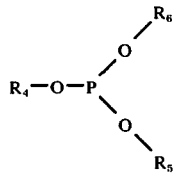

where:

$R_4$, $R_5$, and $R_6$ are each individually selected from the group consisting of hydrogen, addition complexes of hydrogen with amines, alkyl, aryl, alkaryl and cycloalkyl, alkenyl, and provided that in any given such phosphite ester at least one and not more than two of each of $R_1$, $R_2$, and $R_3$ are hydrogen or an addition complex of hydrogen with an amine.

A compound of formulas (1) and (2) typically contains from about 1 to 50 carbon atoms per molecule and preferably from about 8 to 20 . Presently preferred compounds of formulas (1) and (2) include those wherein $R_1$ and $R_2$ are each a same or different lower alkyl group, $R_3$ is an addition complex of hydrogen with an amine wherein the amine is a primary amine which contains at least one alkyl group per molecule, and each such amine alkyl group contains 8 through 14 carbon atoms each, $R_4$ is hydrogen, $R_5$ and $R_6$ are each a same or different alkyl group containing less than 11 carbon atoms each. The phosphate esters are preferred over the phosphite ester. As used herein, the term "lower" has reference to a group containing less than seven carbon atoms each.

The process further involves the step of heating such a resulting mixture to such elevated processing temperatures (e.g. from about 100° F to 1500° F). These steps may be practiced sequentially or simultaneously.

In another aspect, this invention relates to compositions comprising mixtures of a major amount of crude oil material with a small amount of at least one compound from formulas (1) or (2), and also to such compositions which have been heated to a temperature ranging from about 100° to 1500° F.

DETAILED DESCRIPTION

The Mineral Hydrocarbon Mixture and Processing Thereof

The present invention characteristically may be practiced advantageously with any crude oil material, such as one selected from the group consisting of crude oils and reduced crude oils.

Typically, the total amount of formula (1) and/or (2) material added to a crude oil material is less than about 500 parts per million total weight basis. Preferably, the total amount of formula (1) and/or (2) additive admixed with crude oil material ranges from about 2 to 50 parts per million (same basis). Heating times can vary enormously, as those skilled in the art of petroleum refining will readily appreciate, but are generally in the range of about from a few seconds to several hours, though longer and shorter time can be involved.

As used herein, the term "crude oil" can be considered to have reference to materials used as starting feedstocks for a petroleum crude oil refining operation, such as a petroleum having a substantially naturally occuring composition and which composition has not been appreciably altered through the use of distillation or pyrolysis. Examples of crude oils include many materials, such as refinery battery limit crudes (e.g. a crude as it exists in storage vessels preceding refining), degassed crude oils (e.g., a crude which has been stripped at temperatures typically in excess of from about 75° to 125° F to remove therefrom low boiling hydrocarbons, such as lower alkanes and other low volatiles), tar sand crudes (e.g., a product obtained from a destructive distillation of a tar sand), condensate crudes (e.g., a crude obtained by condensation of heavy ends from a natural gas well), shale oils, (e.g., a crude oil obtained from oil shale by destruction distillation followed by hydrotreating), desalted crude oils (e.g, a crude oil which has been subjected to a procedure whereby the content of mineral salts present in a starting crude oil is reduced typically to a salt content not above 5 pounds per 1000 barrels, although the amount of salt remaining in de-salted crude can vary widely as those skilled in the art of petroleum refining will readily appreciate), and the like. Conventional terms describing a crude oil in this art of petroleum sometimes overlap on one another and are not well defined. Presently preferred crude oil starting feedstocks for the present invention include batter limit crude oil, degassed crude oil, and desalted crude oil.

Similarly, as used herein, the term "reduced crude oil" can be considered to have referene to a starting crude oil feedstock which has been subjected to distillation at temperatures which are generally above those employed for making a degassed crude oil using temperatures as above indicated, such as a residual crude oil (usually a liquid) which has not been substantially altered except as a result of heating and removing material therefrom by distillation or pyrolysis. Examples of reduced crude oils include a wide variety of materials, as those skilled in the refinery art will apppreciate readily, such as topped crude oils (e.g., a product which results after gas oils boiling in the range of from about 400° to 575° F have been removed from a crude oil by fractional distillation), atmospheric residues (e.g., a product which results from the fractional distillation of a crude oil in an atmospheric pipe still and which boils above a temperature in the range of from about 350° to 650° F), viscous pitches (e.g., a product which results from a fractional distillation of an atmospheric residue in a vacuum still and which boils above a temperature in the range from about 1000° to 1500° F at pressures of from about 1 to 5 psia. ). Viscous pitches can be considered to include coker feedstocks. Presently preferred reduced crude oils include topped crude oils, atmospheric residues and viscous pitches.

The processing of crude oil materials in a refinery is a relatively well developed art. Characteristically and usually, the processing of crude petroleum comprises a successive series of steps. These steps characteristically and preferably are as follows:

A. heating a crude oil in at least one heat exchanger to a temperature typically in the range from about 100° to 200° F., B. desalting the crude oil typically and preferably by the substeps of (1) turbulently mixing the crude oil which has been preferably first pre-heated as above indicated as typically from about 3 to 8 parts by weight of water for each 100 parts by weight of such crude oil to form an emulsion of the water in oil type, 2. breaking said emulsion through the use of chemical agents, electrical means, or some combination thereof, and 3. separating the resulting aqueous phase from the resulting crude oil phase, C. further heating the resulting crude oil in at least one post desalter heat exchanger to a temperature typically in the range from about 200° to 500 ° F., D. still further heating the resulting crude oil in a furnace to a temperature typically in the range from about 500° to 700° F., E. charging the so-heated crude oil to an atmospheric still wherein such crude oil is progressively fractionally distilled at temperatures typically in the range from about 300° to 650° F under pressures typically ranging from and including atmospheric up to about 50 p.s.i.a. and collecting the distillates until an atmospheric residue results which boils above a temperature typically in the range from about 300° to 650° F, F. heating said atmospheric residue in a vacuum furnace to a temperature typicallly in the range from 650° to 800° F while maintaining a subatmospheric pressure of from about 5 to 14 p.s.i.a. typically, G. charging the so-heated atmospheric residue to a vacuum still wherein such atmospheric residue is progressively fractionally distilled at a temperature typically in the range from about 800° to 1000° F under pressures typically ranging from about 1 to 5 p.s.i.a. and collecting distillates until a viscous pitch results typically boiling in the range from about 1000° to 1500° F at a sub-atmospheric pressure of typically from about 1 to 5 p.s.i.a. and H. progressively heating the viscous pitch in a zone at temperatures typically ranging from about 860° to 900° F at pressures typically ranging from about 50 to 350 psig for a time ranging from about 1 second to 1½ hours.

In the case of step (H), the heating can occur either in a coker zone or in a thermal cracking zone. In the case of a coker zone, the heating is pyrolytic, and the distillates are collected, until a final solid residue is obtained which is a coke. In the case of a thermal cracking zone, the process involved is termed "visbreaking" and the distillates are collected without changing the fluid nature of the starting viscous pitch (as by forming coke). Residence times of the charged material (initially viscous pitch)in a coker zone typically extends for periods of time more than 10 seconds with common coking times ranging from about 45 minutes to 4 ½ hours. Residence times of starting pitch in a visbreaking operation in a thermal cracking zone typically are shorter than about 10 seconds maximum.

These crude oil and reduced crude oil processing steps, as indicated, are well known to the art of petroleum refining and do not constitute as such part of the present invention. Those skilled in the art will appreciate that many variation, etc., can be used in any given refinery operation, involving, for examples, additional steps, substitute steps, recycle loops, and the like. The above summary is merely representative, but characteristic, of the sequence of steps typically found in a refinery when processing crude oil. Petroleum processing is discussed in such reference works as that by Nelson entitled "Petroleum Refinery Engineering", see, for example, chapter 7, pp. 248–260; chapter 8, pp. 265–268; chapter 17, pp. 547–554 and chapter 19, pp. 678–693. All such crude oil processing steps characteristically cause fouling of refinery equipment in absence of an additive or the like, as those skilled in the art well appreciate.

Fouling deposits apparently occur most frequently at temperatures between about 200° and 900° F. The types of equipment affected most frequently include heat exchange surfaces, such as indicated above. The fouling deposits themselves are typically and principally polymerization products and are characteristically black in color. Some are initially gummy masses which convert to coke-like masses at elevated temperatures. Inorganic portions of such deposits frequently contain components, such as silica, iron-oxides, sulfur oxides, iron sulfides calcium oxide, magnesium oxide, inorganic chloride salts, sodium oxide, alumina, sodium sulfate, copper oxides, copper salts, and the like. These deposits are not readily solubilized by common organic solvents and these deposits are distinguishable from the corrosion and sludge formation sometimes occuring in finished products. Conventional antioxidants, stabilizing chemicals, and the like are characteristically relatively ineffective as antifoulants.

During a distillation or pyrolysis carried out with a crude oil material containg formula (1) and/or (2) material, this additive material is characteristically not carried over in the vapors evolved, but remains instead with the residue (reduced crude oil) involved. Chemical and physical changes may occur, of course, in such additive material during a given distillation or pyrolysis operation, but it is now theorized (and there is no intent herein to be found by theory) that by-products , degradation products, and the like, are not appreciably carried over with a vapor phase stream removed during a distillation or pyrolysis operation from a reduced crude oil.

Phosphate Compounds

The total number of carbon atoms for each of $R_1$, $R_2$ and $R_3$ can range between about 1 and 50, with a preferred range being from about 8 through 20 carbon atoms each. Typical examples of suitable phosphate esters include (the specific listing of a given monoester here is intended to include the like listing of the corresponding diester as well; thus, for example, methyl phosphate is intended to include dimethyl phosphate but, in instances where the $R_4$, $R_5$, and $R_6$ are not the same, the di-esters are specifically named): methyl phosphate, ethyl phosphate, n-propyl phosphate, isopropyl phosphate, butyl phosphate, pentyl phosphate, hexyl phosphate, cyclohexyl phosphate, heptyl phosphate, nonyl phosphate, decyl phosphate, lauryl phosphate, lorol phosphate, cetyl phosphate, octadecyl phosphate, heptadecyl phosphate, phenyl phosphate, alpha or beta naphthyl phosphate, alpha or beta naphthenyl phosphate, benzyl phosphate, tolyl phosphate, methyl phenyl phosphate, amyl phenyl phosphate, nonylphenyl phosphate, nonyl phenyl phosphate, 4-amylphenyl phosphate, isobutyl phenyl phosphate, nonyltoly phosphate, di-polyisobutenyl phosphate, di-polysiobutenylphenyl phosphate, polyisobutenylphenyl phosphate, diphenyl phosphate; ethyl phosphate, di-polyisobutenyl, di-polyisobutenyl, and the like.

Many of these phosphate esters, particularly those containing the smaller number of carbon atoms per molecule, are readily available commercially. Methods of preparation of formula (1) compounds are conventional. Thus, for example, phosphorus pentoxide may be added to a solution of an alcohol in an organic solvent (aromatic solvents being slightly usually preferred over aliphatic solvents because of their more polar character). Examples of suitable solvents include kerosenes, heavy aromatic napthas, and the like.

The resulting mixture is heated to an elevated temperature to produce reaction. The reaction products are typically soluble and remain in solution. Preferably, reactants are employed in stoichiometric amounts so that relatively pure product solutions are obtained, since the reactions tend to go to completion. Depending upon the particular alcohol reactant or reactants employed, the reaction temperatures used, as well as upon the respective quantities of reactants present, the reaction product is a phosphate ester having one or two alkyl or other hydrocarbonaceous substituents per molecule, as shown in formula (1) above.

A wide variety of alcohol reactants may be employed to realize specific compounds falling within the scope of formula (1). Phosphorus pentoxide is presently preferred as starting phosphorus compounds, but, as those skilled in the art will appreciate, a variety of other phosphorus compounds may be employed, such as phosphoric acid, phosphorus oxychloride, polyphosphoric acid, phosphorus anhydride, and the like.

The reaction product is usually and preferably one which contains at least one acidic hydrogen atom per molecule which is readily neutralized with a base, preferably for this invention a primary or a secondary amine.

Examples of suitable alcohols include normal, straight chain alcohols such as methanol, ethanol, and those wherein the hydrocarbon portion is n-propyl, n-butyl, n-amyl, n-hexyl, n-hepyl, n-octyl, n-nonyl, n-decyl, n-undecyl, n-dodecyl (lauryl), N-tetradecyl (myristyl), n-hexadecyl (cetyl), and n-octadecyl (stearyl); branched chain primary alcohols such as isobutyl, isoamyl, 2,2,4- trimethyl-l-hexanol and 5,7,7-trimethyl-2-(1,3,3-trimethylbutyl)-1-octanol; and secondary alcohols such a isopropyl, sec-butyl, 2-pentanol, 2-octanol, 4-methyl-2-pentanol, and 2,4-dimethyl-3-pentanol. Examples of alicyclic alcohols are cyclopentanol, cyclohexanol, cycle heptanol, and menthol. Examples of alcohols of the class having ethylenic unsaturation are allyl, crotyl, oleyl (cis-9-octadecen-1-ol), citronellol, and geraniol.

Acetylenic unsaturation is illustrated by propargyl alcohol. Araliphatic alcohols are illustrated by benzyl, 2-phenylethanol, hydrocinnamyl, and alpha-methylbenzyl alcohols. Cinnamyl alcohol is an example of an alcohol containing both aromatic and ethylenic unsaturation.

One excellent source of alcohol which may be used is that class of compounds known as oxo alcohols. These are normally a mixture of various intermediate molecular weight alcohols ranging from 4 to about 16 carbon atoms. Their preparation and description is described in the book *Higher Oxo Alcohols* by L.F. Hatch, Enjay Company, Inc., 1957, which disclosure is hereby incorporated by reference. The general range of both alcohols and ester by-products typifying an oxo alcohol still bottom of the type which may be used in the invention, is as follows:

| Ingredient | Percent |
|---|---|
| Mixed iso-and n-octyl alcohol | 2–20 |
| Mixed iso-and n-nonyl alcohol | 5–40 |
| Mixed iso-and n-decyl and higher alcohols | 25–90 |
| Esters | 20–80 |

Examples of suitable amines include n-Dodecyl amine; n-Tetradecyl amine; n-Hexadecylamine; lauryl amine, myristyl amine; palmityl amine; stearyl amine; oleyl amine; coconut oil amine; tallow amine; hydrogenated tallow amine; cottonseed oil amine; dilauryl amine; dimyristyl amine; dipalmityl amine; distearyl amine; dicoconut amine; dihydrogenated tallow amine; octyl methylamine; octadecyl methyl amine; hexylethyl amine; soya amine 10%; octadecyl 10%, octadaemyl 35%; octadecadienyl 45%; ethyl amine; diethyl amine; morpholine; butyl amine; isopropylamine; diisopropylamine; N-methyl morpholine; triethylamine; aminoethyl ethanolamine; diethanolamine; diethyl ethanolamine; diisopropanol amine; diemethyl-ethanolamine; dimethyl isopropanolamine; N-hydroxy ethyl morpholine; N-methyldiethanolamine; monoethanolamine; monoisopropanolamine; triethanolamine; triisopropanolamine; 1,1-dihydroxymethyl ethylamine; 1,1 -dihydroxymethyl-n-propylamine; polyglycolamine ($H_2NCH_2CH_2$-O-$CH_2CH_2)_nOH$ where $n$ = 1 to 10 inclusive; pyrrolidone; 5-methyl-2-oxazolidone; 2-oxazolidone; imidazole; polyamines of the class (3)

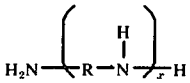

where R is an alkylene radical selected from among $-CH_2-CH_2-$, $-CH_2CH_2CH_2-$, and $CH_3-\underset{\underset{CH_3}{|}}{CH}-CH_3$ and $x$ is an integer of 1–5; 5-benzimidazole; 2-hydroxyethyl imidazole; 2-methyl imidazole; pyrazine; pyridine; piperidine; 2-cyanomethyl-2-imidazoline; cyclohexyl amine, and the like.

One preferred class of amines are highly substituted imidazolines such as those defined by one of the following formulas:

(4)

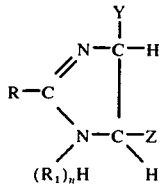

(5)

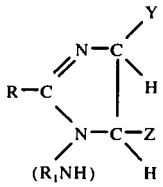

(6)

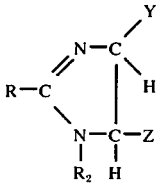

where in formulas (4), (5), and (6) above R is an aliphatic group of from about 1 to 22 carbon atoms in chain length, Y and Z are selected from the group consisting of hydrogen and lower aliphatic hydrocarbon groups of not more than 6 carbon atoms in chain length, $R_1$ is an alkylene radical of about 1 to 6 carbon atoms, $R_2$ is a radical selected from the group consisting of R and hydrogen, and n is an integer of from about 1 to 50. Imidazolines of the type shown in Formulas (4), (5) and (6) are conveniently prepared by reacting a monocarboxylic acid such as a saturated or unsaturated fatty acid with an alkylene polyamine or hydroxyalkyl alkylene diamine in accordance with well-known methods. The product imidazolines may be further reacted via oxyalkylation to produce other useful derivatives. Methods of preparing imidazolines of this type are given in the article, "The Chemistry of the s-Imidazolines and Imidazolidines", by R.J. Ferm and J.L. Riebsomer, Chemical Reviews, Vol. 54, No. 4, August, 1954. Particularly useful imidazolines for use in the practice of the invention are those described in Wilson U.S. Pats. Nos. 2,267,965 and 2,355,837. Two typical imidazolines of the type described by the formulas above are 1-(2hydroxyethyl)-coco imidazoline and 1-(2 hydroxyethyl)-2 tall oil imidazoline, both of which compounds are conveniently prepared using the teachings of Wilson U.S. Pat. No. 2,267,965.

For purposes of illustrating several other types of typical imidazolines that may be used, the following are given by way of example:

1-(2-hydroxyethyl)-2-undecyl imidazoline
1-(2-hydroxyethyl)-2-tridecyl imidazoline
1-(2-hydroxyethyl)-2-pentadecyl imidazoline
1-(2-hydroxyethyl)-2-heptadecyl imidazoline 1-(2-aminoethyl)-2-heptadecyl imidazoline
1-(2-aminoethyl)-aminoethyl-1-2-undecyl imidazoline
1-(2-aminoethyl)-aminoethyl-1-2-tridecyl imidazoline The fatty acids are most generally reacted with a polyalkylene polyamine such as diethylene triamine, triethylene tetramine, tetraethylene pentamine, or mixtures thereof, or a polyamine alcohol such as aminoethyl ethanolamine. The amine may likewise be substituted with lower alkyl groups.

A particularly preferred class of amines are tertiary-alkyl primary amines. The tertiary-alkyl primary amines have the formula:

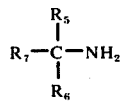

(7)

More specifically, the tertiary-alkyl primary amine constitutes a component wherein $R_5$ and $R_6$ are lower alkyl groups, usually methyl groups, and $R_7$ constitutes a long chain alkyl radial composed of 8 to 19 carbons. Tertiary-alkyl primary amines which have been found eminently suitable for the instant invention are "Primene 81-R" and "Primene JM-T". Primene 81-R is reported by its manufacturer to be composed of principally tertiary-alkyl primary amines having 11–14 carbons and has a molecular weight principally in the range of 171–213, a specific gravity of 25° C of 0.813, a refractive index of 1.423 at 25° C and a neutralization equivalent of 91. Primene JM-T is reported by the manufacturer to be composed of tertiary-alkyl primary amines having 18–22 carbons with a molecular weight principally in the range of 269–325, a specific gravity at 25° C of 1,456 and a neutralization equivalent of 315.

The primary constituent of Primene 81-R is reported to be:

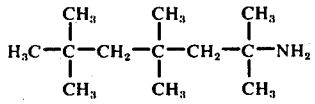

(8)

The primary constituent of Primene JM-T is reported to be essentially the same structure as Primene 81-R, but with 22 carbons. "Primene" is a trademark of the Rohm & Haas Company for its brand of tertiary alkyl primary amines.

Phosphate Compounds

The total number of carbon atoms for each of $R_4$, $R_5$and $R_6$ can range betwen about 1 and about 50 with the preferred range being between about 8 and 20 carbon atoms per hydrocarbon radical. Typical examples of suitable phosphite esters include (the specific listing of a given monoester here is intended to include the like listing of the corresponding diester as well thus, for example, methyl phosphite is intended to include dimethyl phosphite, but in instances where the $R_4$, $R_5$ and $R_6$ are not the same, the diesters are specifically named): methyl phosphite, ethyl phosphite, n-propyl phosphite, isopropyl phosphite, butyl phosphite, pentyl phosphite, hexyl phosphite, cyclohexyl phosphite, heptyl phosphite, nonyl phosphite, decyl phosphite, lauryl phosphite, lorol phosphite, cetyl phosphite, octadecyl phosphite, heptadecyl phosphite, phenyl phosphite, alpha or beta naphthyl phosphite, alpha or beta naphthenyl phosphite, benzyl phosphite, tolyl phosphite, methyl phenyl phosphite, amyl, phenyl phosphite, diamyl phenyl phosphite, nonylphenyl phosphite, isobutyl phenyl phosphite, nonyltolyl phosphite, di-polyisobutenyl phosphite, di-polyisobutenylphenyl phosphite, polyisobutenylphenyl phosphite, diphenyl phosphite, di-polyisobutenyl, di-polyisobutenyl, and the like.

Many of these phosphite esters, particularly those containing a small number of carbon atoms per molecule, are readily available commercially. Methods of preparation are conventional. Some of these esters, particularly those having the longer alkyl chains although presently not available commercially, are readily prepared by reacting one, two, or three moles of the corresponding alcohol or phenol with each mole of a phosphorus trihalide, such as phosphorus trichloride or phosphorus tribromide. This is a conventional reaction and there are other ways, also conventional, of producing these various phosphite esters. Thus, organophosphites may be conveniently prepared by direct esterization of phosphorous acid with alcohol.

The present nvention is not concerned with the particular method by which the phosphite esters or phosphate esters are produced. In those cases where mono- or di-esters are formed, it is sometimes desirable, following the esterification reaction, to treat the reacted mixture with water, dilute aqueous caustic, or dilute aqueous mineral acid in order to hydrolyze off the residual chlorine of bromine atoms present by reason of the particualr trivalent or pentavalent phosphorus compound employed as an original reactant. Amine salts of phosphite esters do not appear to be as active antifoulants as do other materials of formulas (1) and (2 ).

Mixing and the Compositions

Only relatively small amounts of esters of formulas (1) and/or (2) are used to produce a reduction both in fouling deposits, and/or a suppression of fouling material in the typical practice of this invention. Preferably, the total amount of such ester compounds present in a total mixture ranges from about 2 to 50 parts per million by weight, and more preferably ranges from about 4 to 10 parts per million, though larger and smaller amounts of such esters may be employed, as those skilled in the art will appreciate. Owing to the complexity of the variables involved, it is not possible to indicate optional concentrations of additives for all possible use situations.

Mixing of material from formula (1) and/or formula (2) with crude oil material may be accomplished by any convenient or conventional means before or during a heating of such materials. Typically, phosphate compound(s) and/or phosphite compound(s) are injected through a chemical feed pump or the like ahead of the heat exchangers subject to fouling, or the like. Preferably, injection takes place as far back in a system as possible. To assure substantially complete dispersion, a suitable injection point should be selected, such as into the suction region of a charge pump. Sleeve type arrangements termed "quills" may be preferably used to inject additives into process streams which extend into a line to cause better mixing. The ester compound or compounds are preferably fed in solution form using a liquid which is soluble or miscible with the mineral hydrocarbon mixture being treated. When large pump feeding rates are involved, one may employ more dilute solutions than at lower pumping rates.

The solvent used for such a solution of a formula (1) or formula (2) compound can vary widely. In general, such should have higher boiling point than that of the more volatile components of the process stream into which the resulting solution is to be injected. A presently preferred type of solvent is one which has a boiling point high enough to be suitable for many injection locations, such as a heavy aromatic hydrocarbon mixture (of the type derived from petroleum refining) having a boiling point in the range from about 350° to 550° F. Preferably, such has a sulfur content not greater than about 1 weight percent (based on total solvent weight). Typically and preferably such a solvent is comprised of at least 90 weight percent (total solvent weight basis) of six membered aromatic rings which may each be substituted by at least one alkyl group having from 3 through 7 carbon atoms each, as those skilled in the art will appreciate. The total amount of formula (1) and/or (2) compound dissolved a given solution can vary widely, but usually and conveniently this amount falls in the range of from about 10 to 40 percent by weight of formula (1) and/or (2) compound(s) per 100 weight percent total solution. Neither the solvent nor the phosphorus ester appears to affect generally the useful properties of either the crude oil material to which such a solution is added or the processed reduced crude oil containing residual materials derived from such a solution.

When formula (1) and/or (2) material is fed to a stream having a temperature above about 200° F, it is preferred to have a nipple connecting the feedline to the process line which is made of stainless steel. For best results, the equipment is preferably initially thoroughly cleaned, most preferably by mechanial means. Starting charge dosages are preferably greater than subsequent dosages.

In one preferred mode of practicing this invention, at a given injection point, an initial dosage rate of from about 2to 50 parts per milliion of a formula (1) or (2) compound is used. After an operational period of, for example, about 1 to 2 weeks, this dosage rate can be reduced to a level of from about 5to 20 parts per million. Thereafter, for an extended operating period, the level of fouling, or the rate of fouling, surprisingly does not appear to change substantially and remains substantially below the level of fouling associated with refinery crude oil material processing which does not employ a formula (1) or (2) compound. Such an antifouling maintenance procedure appears to be new in this art and represents one of the advantages of the present invention. The reason why such a non-fouling effect is achieved with such reduced dosage rates (compared to starting dosage rates) is not known, but it theorized that this effect may possibly be associated with micellular agglomerates building upon the inside surfaces of refinery equipment contacted with a formula (1) or(2) compound.

Also, in another preferred mode pf practicing the present invention, phosphorus ester of formula (1) and/or (2) is mixed simultaneously with a crude oil material feed stream being processed at various successive locations therealong. For example, such ester material can be first injected into and mixed with a crude oil steam before such undergoes the initial heating which is identified above as step (A). Thereafter, and simultaneously, such material may also be injected into a process stream before each of the steps identified above as steps (B) through (H) using a same or similar rate of additon at each injection location. If such material is not so injected at each such location, it is preferred to inject such at least before steps (A), (C), (F) and (H).

The componds operate in a manner not altogether clear, and, while there is no intent to be bound by theory herein, it is theorized that the compound function to reduce fouling by retarding orgainc polymer formation and also be dispersing organic and inorganic sludge like material which would otherwise build up on heat exchange surface. Build up rates of deposits of fouling material on interior surfaces of processing equipment is usually such that months or even years of actual operation time may be involved before a shut down is forced for reasons associated with a build up of fouling deposits, but those skilled in the art will appreciate that fouling can occur rapidly, so that equiment operational failure can occur in a matter of even days under conditions of heavy fouling. The compounds of formula (1) and/or formula (2) are well suited for use with heat transfer surfaces of ferrous metals (such as stainless steel or carbon steel) or of aluminum. The compounds of formula (1) and formula (2) appear to be particularly effective as antifoulants at tube wall temperatures below about 1200° F and at oil temperatures below about 600° to 950° F, though they can be uses as antifoulants at higher temperatures, as taught therein.

In another preferred mode of practicing this invention, the additive material of formula (1) and/or (2) is added to a crude oil material being processed in previously fouled refinery equipment, as taught therein, and reduction in the fouling of previously fouled refinery equipment is characteristically achieved by this invention. Such a reduction is shown in such ways as reduced pressure drop across a given unit or zone, increased temperature (better heat transfer) across a given unit (such as a heat exchanger) or zone, reduced furnace fuel consumption, and the like.

After being heat processed at temperatures ranging from 100° to 500° F, a composition of this invention which is initially comprised of crude oil type material and organophosphorous ester appears to have undergone chemical change but the exact nature of such changes is not now known. For one thing, differential thermal analysis of certain heated compositions comprising crude oil or reduced crude oil with a compound of formula (1) or (2) above suggests that there is a possibility that such a compound of formula (1) or (2) undergoes some sort of decomposition or change in structure at temperatures below those occuring in the hotter process zones utilized in the refining of crude oil materials as described herein.

Suprisingly, when an additive of this invention is mixed with crude oil(s) in the processing thereof as taught herein, but employing refinery equipment which is already at least partially fouled, a reduction in fouling rates and even in already formed fouling depoits can be observed, as indicated.

The process of this invention is characteristically practiced without involving catalysis.

As those skilled in the art of petroleum refining will appreciate, however, one can add to a viscous pitch or the like to be used for a visbreaking operation up to about 25 weight percent (based on 100 weight percent of total mixed system weight) of some hydrocarbon system, such as a distillate from an atmospheric still, as a means for enhancing yield of product condensate from such operation, as known and apppreciated by those skilled in the art of petroleum refining, or the like.

In the crude oil processing steps above described, a coker furnace can follow step (G) and precede step (H) so that after step (G) the following processing step sequence occurs after step (G) in place of step (H):

H' heating said viscous pitch in a furnace to a temperature in the range from about 1000° to 1500° F at near atmospheric pressure and I' passing said so heated pitch into a flash zone at temperatures typically in the range from about 860° to 900° F at pressures typically of from about 50 to 350 p.s.i.g. Such flash zone can either be a coker zone or a visbreaking zone, as above indicated. If a coker zone, residence time in such zone is prolonged and pyrolysis occurs. If a visbreaker zone, residence time is brief and cracking occurs, giving rise to naptha and gas oil as lighter products and producing a residuum which is less viscous than the charge stock.

EMBODIMENTS

The present invention is further illustrated by reference to the following Examples. Those skilled in the art will appreciate that other and further embodiments are obvious and within the spirit and scope of this invention from the teachings of these present Examples taken with the accompanying specification.

EXAMPLE 1

To a clean, dry, nitrogen blanketed 2-liter stainless steel reactor provided with an efficient stirrer and a water-cooled, steam-heated jacket is charged 778 grams of mixed xylenes as an aromatic hydrocarbon solvent system. Agitation is started and 390 grams of isooctanol is added. To the resulting agitated solution is added 142 grams of phosphorus pentoxide, thereby to form a slurry in which the phosphorus pentoxide is suspended as fine particles. The temperature of the reactor is raised to about 140° C and held at this tempeature for about 2hours at which point the system characteristically is clear in appearance. The reactor is then cooled to 60° C. The product is a solution of mixed octyl phosphates in aromatic hydrocarbon solvent.

To this product solution is added with stirring 246 grams of Primene 81-R. Primene 81-R is a trademark of the Rohm & Hass Company for its brand of principally tertiary-alkyl primary amines having 11–14 carbons which have a molecular weight principally in the range of 171–213, a specific gravity at 25° C of 0.813, a refractive index of 1.423 at 25° C and a neutralization equivalent of 191. The resulting product is a 50 weight percent weight percent solution of amine salt of mixed octyl phosphates in mixed xylenes.

EXAMPLES 2–4

Using the procedure of Example 1, a series of various phosphate ester solution within the scope of formula (1) above are prepared. The reactants with phosphorous pentoxide and the reaction products are summarized below in Table I in each case.

TABLE I

| Ex. No. | Alcohol Reactant | Qty | Reaction Product |
|---|---|---|---|
| 2 | N-Butyl Alcohol | 222 | Mixed Butyl Phosphates |

TABLE I-continued

| Ex. No. | Alcohol Reactant | Qty | Reaction Product |
|---|---|---|---|
| 3 | n-Decyl Alcohol | 474 | Mixed Decyl Phosphates |
| 4 | 1,10 Decanediol | 177 | 1,10 Decamethylene Diphosphate |

EXAMPLES 5–7

A series of various mono, and di phosphite esters within the scope of formula (2) above are prepared. The preparation procedure encompasses reacting stoichemetric molar quantities of the corresponding alkanol with one mole of $PCl_3$ under reflux conditions and until no further amounts of hydrogen chloride are evolved. Therafter, to accomplish substantially complete hydrolysis, the appropriate number of moles of water are added to the reaction mixture. The reactants with phosphorus trichloride and the reaction products are summarized below in Table II in each case.

TABLE II

| Ex. No. | Alcohol Reactant | Qty. of $PCl_3$ | Qty. of Water Used for Hydrolysis | Reaction Product |
|---|---|---|---|---|
| 5 | ethanol (276g) | 412.5g | 54g | Diethyl Hydrogen Phosphite |
| 6 | butanol (222g) | 412.5g | 108g | Mono Butyl Hydrogen Phosphite |
| 7 | 2-ethyl hexanol (780g) | 412.5g | 54g | Dioctyl Phosphite |

EXAMPLE 8

Antifouling Evaluation Apparatus and Procedure

Apparatus for accelerated fouling test comprises a feed tank, a nitorgen pressurizing system, a valve and rotameter to control the flow of feed stock from the fuel tank to the heater section and the waste tank, and a heater section which consists of an annular single tube heat exchanger through which the feed stock flows and is heated to field process temperatures.Flow from the feed tank to the waste tank by way of the heat exchanger is accomplished by maintaining the pressure in the waste tank lower than that of the feed tank.

A feed stock entering at the bottom of the exchanger system is at room temperature and the desired pressure. As the feed travels up the exchanger, it is heated to progressively increasing temperatures ranging from about 100° F to about 1000° F. During this rapid change in heat content, the feed stock degrades as it slowly passes through the heat exchanger, forming particles, which tend to adhere to the exchanger inside surfaces.

The deposits thus formed on the inner walls of the heat exchanger tube in such apparatus depend on the nature of the feed stock and the temperatures applied thereto. Both skin temperature and fluid temperature are significant factors. These deposits may range from a yellow-brown gum or light varnish in the vicinity of the relatively cool end of the tube, to heavy coke at the relatively hot end. The type of deposit on each distinguishable area of the tube is rated visually according to some system, such as the following system:

| Variety of deposit: | Rating No. |
|---|---|
| Clear tube | 0 |

-continued

| Variety of deposit: | Rating No. |
|---|---|
| Tube rainbowing or golden yellow | 1 |
| Light layer of varnish | 2 |
| Medium layer of varnish | 3 |
| Heavy layer of varnish, light coke layer | 4 |
| Moderate layer of coke | 5 |
| Heavy layer of coke | 6 |

Following this visual rating, the rating number assigned to each distinguishable area on the tube is squared and multiplied by the average length of that area. These numbers are added to give a total ranging number for each test.

This procedure is illustrated in the following example:

| Type of Deposit | Light Varnish | Medium Varnish | Light Coke | Heavy Coke |
|---|---|---|---|---|
| Rating | 2 | 3 | 4 | 6 |
| Inches | 4 | 2 | 6 | 1 |
| | 2 | 2 | 2 | 2 |
| | (2) X4 + | (3) X2 + | (4) X6 + | (6) X1 |
| | 16 + | 18 + | 96 + | 36 = 166 |

This rating system emphasizes the quality and quantity of coke formed from the thermal decomposition of the feed stock and at the same time takes into account deposits formed from gums which are already present in the stock or which form during the heating process.

The test conditions chosen were typical of those encountered in refinery heat exchangers.

Using such apparatus and procedure, there is employed a desalted midcontinent sour crude oil as the feed stock. Various additives are evaluated. Each additive is first dissolved in Exxon Heavy Aromatic Solvent to form a 20 Wt. % solution thereof (100 Wt. % total basis). The additives used, the rates of use, and the results are as recorded in Table IV below:

TABLE IV

| No. | Additive | Amount Additive Admixed p.p.m. | Tube Rating | % Fouling Reduction (compared to control) |
|---|---|---|---|---|
| 8.a | Untreated control | | 130 | additive-free |
| 8.1 | Decyl Acid Phosphate | 300 | 9 | 92 |
| 8.2 | Decyl Acid Phosphate-Primene JMT Salt | 225 | 40 | 62 |
| 8.3 | Ibid - Primene JMT Salt | 300 | 25 | 80 |
| 8.4 | Diethyl Hydrogen Phosphite | 150 | 25 | 90 |
| 8.5 | Octyl Acid Phosphite | 500 | 31 | 73 |
| 8.6 | Mixed Octyl Acid Phosphite-Primene 81R Salt | 500 | 85 | 27 |

The preceding evaluation results demonstrate that compounds within the scope of each of formulas (1) and (2) are useful as antifoulants in petroleum refining of crude oil feedstocks.

This evaluation also demonstrates that compounds of formulas (1) and (2) are specifically useful in reducing fouling in a post desalter heat exchanger, and in other subsequent conventional refinery crude oil processing steps, as above explained, following a crude oil desalting operation.

EXAMPLE 9

Using the same apparatus and procedure of Example 8 (including feed stock), some of the same additives are retested with the same feed stock, but using reduced rates of additive addition to feed stock which rates are similar to those employed in commercial refinery operations. The additives used, the rates of use, and the results are indicated in Table V below. It is noted that the higher rates of additive addition to feed stock used in Example 8 are employed because of the accelerated nature of the test procedure; thus, the higher rates are useful in determining whether or not a particular additive is effective as an antifoulant.

TABLE V

| Ex. No. | Additive | Amount Additive Admixed p.p.m. | Comment Relative to Untreated Control |
|---|---|---|---|
| 9.1 | Decyl Acid phosphate Primene JMT Salt | 10 | fouling reduced |
| 9.2 | Diethyl Hydrogen phosphite | 10 | fouling reduced |
| 9.3 | Mixed Octyl Acid Phosphate Primene 81R Salt | 10 | fouling reduced |

The additives rates employed in this Example are illustrative of the rates utilized in actual refinery operations. The results shown in Table V demonstrate that compounds of formulas (1) and (2) above are useful as antifoulant additives in refinery processing of crude oil.

EXAMPLE 10

Using the same apparatus and procedure of Example 9 (including feed stock) certain other additives are evaluated. The additives used, the rates of use and the results are indicated in Table VI below.

TABLE VI

| Ex. No. | Additive | Amount Additive Admixed p.p.m. | Comment (Relative to Untreated Control) |
|---|---|---|---|
| 10.1 | Primene 81-R Amine Salt of Mixed Octyl Phosphate (1) | 100 | fouling reduced |
| 10.2 | (same as 10.1) | 3 | fouling reduced |
| 10.3 | Mixed Butyl Phosphates (2) | 300 | fouling reduced |
| 10.4 | Mixed Decyl Phosphates (3) | 300 | fouling reduced |
| 10.5 | 1, 10 Decamethylene di-phosphate (4) | 300 | fouling reduced |
| 10.6 | Monobutyl Hydrogen Phosphite (5) | 300 | fouling reduced |

Table VI footnotes:
(1)Material of type prepared in Example 1
(2)Material of type prepared in Example 2
(3)Material of type prepared in Example 3
(4)Material of type prepared in Example 4
(5)Material of type prepared in Example 6

The results shown in Table VI demonstrate that compounds of formulas (1) and (2) above are useful as antifoulant additives in refinery processing of crude oil.

EXAMPLE 11

The same apparatus and procedure of Example 9 are used again except that in place of the desalted midcontinent sour crude oil there is employed as a feed stock the following materials:

a. a cooker charge feed stock, and b. midcontinent refinery battery limit crude (e.g. a feed crude to a desalter preheater).

These evaluations are summarized in Table VII below.

TABLE VII

| No. | Additive | Feedstock (Particular Feedstock As Indicated In Test | Amount Additive Admixed With Feedstock (ppm) | Comment (Relative To Untreated Control Of Same Feedstock |
|---|---|---|---|---|
| 11.1 | mixed mono and di decyl acid phosphate | (a) | 300 | fouling reduced |
| 11.2 | mixed mono and di decyl acid phosphate | (a) | 3 | fouling reduced |
| 11.3 | mixed mono and di decyl acid phosphate | (b) | 300 | fouling reduced |
| 11.4 | mixed mono and di decyl acid phosphate | (b) | 3 | fouling reduced |
| 11.5 | mixed mono and di octyl acid phosphate primene 81 R salt | (a) | 300 | fouling reduced |
| 11.6 | di-(p-tert.butyl) phenyl hydrogen phosphite | (b) | 300 | fouling reduced |
| 11.7 | mixed nonyl phenyl acid phosphate primene 81 R salt | (b) | 300 | fouling reduced |

The results shown in Table VII demonstrate that compounds of formulas (1) and (2) above are useful as antifoulant additives in refinery processing of crude oil.

EXAMPLE 12

Refinery battery limit crude oil (midcontinent sour) is continuously fed to a desalter preheater and heated to a temperature in the range from about 150° to 180° F. Such preheated crude is then continuously charged to a desalter.

In the desalter feed line water is turbulently mixed across an orifice with the crude oil at a rate of from about 3 to 8 parts by weight of water for each 100 parts by weight of said crude oil thereby forming an emulsion of the water in oil type.

The resulting emulsion is then passed through grids across with an electric field of 2000–4000 volts per inch is maintained as a result of which the emulsion is broken. The resulting water phase is collected and discarded. A Howe-Baker Engineers Desalter unit is used which is equipped with a Three Type SVS Electrode. The resulting desalted oil phase is collected and is removed and charged continuously to a series of three post desalter heat exchangers wherein such crude oil is heated to a temperature in the range of from about 300° to 450° F continuously. Next, the so-heated crude oil is passed into a furnace wherein the temperature of the oil is further raised to a value in the range from 550° to 700° F. The resulting so heated crude oil is then charged to an atmospheric pipe still wherein, by fractional distillation, three distillate fractions are produced and collected, which are identified as follows:

1. A light-run fraction consisting primarily of $C_5$ and $C_6$ hydrocarbons, but also containing any $C_4$ and higher gaseous hydrocarbons present and dissolved in the starting crude oil.

2. A naphtha fraction having a nominal boiling range of from about 200° to 400° F (93–204° C).

3. A light distillate with a boiling range of from about 400° to 650° F (204° to 343° C).

The residual crude oil (on atmospheric residue) remaining boils at a temperature of from about 350° to 650° F.

The atmospheric pipe still and the vacuum still used are each equipped with numerous trays through which the hydrocarbon vapors pass in an upward direction. Each tray contains a layer of liquid through which the vapors can bubble and the liquid can flow continuously by gravity in a downward direction from one tray to the next one below. As the vapors pass upward through the succession of trays, they become lighter (lower in molecular weight and more volatile), and the liquid flowing downward becomes progressively heavier (higher in molecular weight and less volatile). This countercurrent action results in a fractional distillation or separation of hydrocarbons based on their boiling points. Liquids are withdrawn from preselected trays as a net product, the lighter liquids such as naphtha being withdrawn from trays near the top of the column, and the heavier liquids, such as diesel oil, being withdrawn from the trays near the bottom. The boiling of the net product liquid depends on the tray from which it is taken. Vapors containing the $C_8$ and lighter hydrocarbons are withdrawn from a top region of the distillation column as a net product, while a liquid stream boiling higher than about 650° F (343° C) is removed from a bottom region of the distillation column. This product liquid stream is sometimes called the atmospheric residue.

This atmospheric residue is now further heated in a vacuum furnace to a temperature in the range of from about 650° to 800° F while maintaining a subatmospheric pressure of from about 5 to 14 psia. This so heated resulting residual crude oil is then progressively fractionally distilled in a vacuum still at temperatures in the range of from about 800° to 1000° F under subatmospheric pressures ranging from about 1 to 5 psia. The distillate collected comprises a heavy gas oil having a boiling range of from about 650° to 1050° F (343° to 566° C). The residue remaining is a substantially non-distillable residual viscous pitch which has a temperature in the range of from about 1000° to 1500° F at a pressure of from about 1 to 5 psia.

This pitch material is then continuously charged to a coker furnace which is maintained at pressures of from about 30 to 50 psig., and temperatures in the range from about 750° to 920° F and the resulting heated pitch is then charged to a coker zone. The resulting distillates produced by pyrolysis are collected and separated until finally a solid coke product is obtained. The pitch charged to such coking unit results in naphtha and gas oil distillates and coke residues as main products.

The crude oil and the atmospheric residue are brought to their desired temperatures in tubular heaters (furnaces). Oil to be heated is pumped through the inside of the tubes which are contained in a refractory combustion chamber fired with oil or fuel gas in such manner that heat is transferred through the tube wall in part by convection from hot combustion gasses and in part by radiation from the incandescent refractory surfaces.

This crude oil processing arrangement is equipped with a series of sleeve-type arrangements termed "quills" for purposes of injecting additives into the process streams involved. Thus, one quill is located in the feed line to the pre-desalter heat exchanger (termed in Table IX quill No. 1). Another quill is located between the desalter unit and the post desalter heat exchanger (termed quill No. 2). Another quill is located in the line between the post desalter heat exchanger and the furnace (termed quill No. 3). Another quill is located aligned between the furnace and the atmospheric pipe still (termed quill No. 4). Another quill is located in the line between the bottom liquid stream (the atmospheric residue) from the atmospheric pipe still and the vacuum furnace (termed quill No. 5). Another quill is located in the line between the vacuum furnace and the vacuum column (termed quill No. 6). Finally, another quill is located in the line between the vacuum still and the coker zone (termed quill No. 7).

A series of solutions are prepared of various additive compounds of formula 1 and formula 2 (above). The solvent in all cases is generally a heavy aromatic hydrocarbon (petroleum derived) having a boiling point in the range of from about 300° to 650° F. The additives used and the concentration of such additives in each respective solution are summarized in Table VIII below.

The equipment train here involved has a capacity to process at least about 1,000 barrels of crude oil daily. Before being equipped with quills as above described, this equipment had been in use for a period of time in excess generally of about 3 months and the interior walls of substantially all of the pieces of equipment involved were known to carry substantial fouling deposits thereon.

Various individual solutions as above described are injected into the various process streams which are quill equipped as above described at specified rates of injection for specified intervals of time at the end of which the equipment downstream from the point of injection is investigated to determine the extend of fouling or the condition of fouling associated therewith if such condition is then compared to the starting condition. Details and results are tabularized in Table IX below, for convenience. As Table IX indicates, the compounds of formula (1) and of formula (2) are effective in controlling and in actually reducing the fouling of internal refinery equipment surfaces. Reduction in fouling of previously fouled equipment is demonstrated by a decrease in pressure drop or an increase in temperature at a given process stream point achieved after use as described in this Example of additives of this invention for periods of 20 to 30 days. See footnotes to Table IX below for measurements and times.

TABLE VIII

| Ex. No. | Additive Type | Concentration of additive in solution (wt. %) | Solvent (Characterization for each solvent given by footnotes |
|---|---|---|---|
| 12.a | Mixed Octyl Phosphate Primene 81-R Amine Salt | 20 | Exxon Heavy Aromatic Solvent[1] |
| 12.b | DI Ethyl Hydrogen Phosphite | 10 | Texaco Aromatic Solvent[2] |
| 12.c | Mixed Butyl Phosphate Primene 81-R Amine Salt | 25 | Texaco Aromatic Solvent[2] |
| 12.d | Di Phenyl Hydrogen Phosphite - Primene 81-R Salt | 20 | Texaco Aromatic Solvent[2] |
| 12.e | Mixed p - Tert Butyl Phenyl Phosphate | 15 | Texaco Aromatic Solvent[2] |
| 12.f | Mono Cyclohexyl Dihydrogen Phosphite | 20 | Texaco Aromatic Solvent[2] |
| 12.g | Mixed Isobutenyl Phosphate | 25 | Exxon Heavy Aromatic Solvent[1] |
| 12.h | Di Benzyl Hydrogen Phosphate | 30 | Exxon Heavy Aromatic Solvent[1] |

Table VIII footnotes:
[1]90–95% Aromatics, Boiling Range 318–600° F.
[2]95–98% Aromatics, Boiling Range 401–662° F.

TABLE IX

| Ex. No. | Additive solution No. | Total Additive Conc. in PPM based on initial crude charge rate | Quills where added 1 | 2 | 3 | 4 | 5 | 6 | 7 | Total time additive so added at each quill | fouling results |
|---|---|---|---|---|---|---|---|---|---|---|---|
| 12.1 | 12a | 20 | — | 20 | — | — | — | — | — | 6 Months | (1) |
| 12.2 | 12c | 20 | 10 | 10 | — | — | — | — | — | 6 Months | (1) |
| 12.3 | 12b | 30 | — | 10 | 10 | — | 10 | — | — | 9 Months | (2)-(4) |
| 12.4 | 12b | 40 | — | 20 | — | — | 10 | — | 10 | 3 Months | (2) fouling |
| 12.5 | 12a | 50 | 10 | 20 | 10 | — | 10 | — | 10 | 4 Months | (2) reduced |
| 12.6 | 12c | 25 | — | — | 15 | — | 10 | — | — | 9 Months | (2) |
| 12.7 | 12a | 20 | — | — | — | 10 | — | 10 | -- | 2 Years | (5) |
| 12.8 | 12b | 25 | — | — | — | — | — | — | 25 | 4 Months | (3) |
| 12.9 | 12a | 20 | 20 | — | — | — | — | — | — | 1 Year | |

Table IX Footnotes:
(1) Crude Temperature leaving the exchangers increased 30° –40° F
(2) Fuel gas consumption of furnaces decreased by 10%
(3) Coker run length extended from 2 months to 4 months
(4) Pressure drop across exchangers decreased from 50 to 25 psig during test
(5) Turnaround inspection showed lower trays in stills to be substantially free of deposits

EXAMPLE 13

An equipment train like that described above in Example 12 which has been in prolonged use (e.g. about 3 months) and is known to be fouled is employed except that here, in place of the thermal coking unit there is employed a thermal cracking unit (visbreaking) for further processing pitch from the vacuum column. In this unit the pitch is processed under relatively mild conditions to reduce its viscosity, (for times of about 1–2 seconds at temperatures ranging from about 860° to 900° F.

The equipment is provided with quills in a manner similar to that described in the preceding example except that here the last quill precedes the thermal cracking unit.

Solutions of compounds of formula 1 and of formula 2 are prepared as described in the preceding example and as shown in Table VIII and are used similarly to the manner described in the preceding Example. The results are tabularized below in Table X. The results indicate that the compounds of formulas 1 and 2 are effective in reducing fouling. Fouling normally readily occurs in the visbreaker preheat process train and is substantially reduced by the practice of this invention.

TABLE X

| Ex. No. | Additive solution No. | Total Additive Conc. in PPM based on initial crude charge rate | Quills where added 1 | 2 | 3 | 4 | 5 | 6 | 7 | Total Time Additive so added at each quill | Fouling results |
|---|---|---|---|---|---|---|---|---|---|---|---|
| 13.1 | 12a | 25 | — | 25 | — | — | — | — | — | 6 Months | FOULING REDUCED |
| 13.2 | 12b | 35 | 10 | 25 | — | — | — | — | — | 9 Months | |
| 13.3 | 12c | 40 | — | 15 | 15 | — | 10 | — | — | 9 Months | |
| 13.4 | 12d | 50 | — | — | — | 25 | — | 25 | — | 6 Months | |
| 13.5 | 12e | 20 | — | — | — | — | — | — | 20 | 6 Months | |
| 13.6 | 12f | 15 | 5 | 5 | 5 | — | — | — | — | 9 Months | |
| 13.7 | 12g | 25 | — | — | 25 | — | — | — | — | 6 Months | |
| 13.8 | 12h | 35 | — | — | — | — | — | — | 35 | 6 Months | |

EXAMPLE 14

An equipment train like that described above in Example 12 is employed except that here such train is previously cleaned of all fouling deposits before being used. The procedures are identical to those described in Example 12. The results are described below in Table XI. As Table XI indicates, the compounds of formulas (1) and (2) are effective in controlling and in substantially preventing the fouling of internal refinery equipment surfaces. Prevention of fouling is demonstrated by maintenance of substantially constant pressures and temperatures at given process stream points over prolonged periods of time (e.g. in excess of 60 days) when additives of this invention are used in the process streams as indicated in Table XI. Footnotes for measurements and times.

EXAMPLE 15

An equipment train like that described above in Example 13 is employed except that here such train is previously cleaned of all fouling deposits before being used. The procedures are identical to those described in Example 13. The results are described below in Table XII. As Table XII indicates, the compounds of formulas (1) and (2) are effective in controlling and in substantially preventing the fouling of internal refinery equipment surfaces. Prevention of fouling is demonstrated by maintenance of substantially constant pressures and temperatures at given process stream points over prolonged periods of time (e.g. in excess of 60 days) when additives of this invention are used in the process streams as indicated in Table XII. Footnotes for measurements and times.

TABLE XI

| Ex. No. | Additive solution No. | Total Additive Conc. in PPM based on initial crude charge rate | Quills where added 1 | 2 | 3 | 4 | 5 | 6 | 7 | Total Time additive so added at each quill | Fouling results |
|---|---|---|---|---|---|---|---|---|---|---|---|
| 14.1 | 12a | 20 | 20 | — | — | — | — | — | — | 6 Months | FOULING REDUCED |
| 14.2 | 12b | 20 | — | — | — | — | — | — | 20 | 6 Months | |
| 14.3 | 12c | 30 | — | — | — | 15 | — | 15 | — | 9 Months | |
| 14.4 | 12c | 40 | — | — | 20 | — | 20 | — | — | 6 Months | |
| 14.5 | 12b | 50 | 10 | 10 | 10 | — | 10 | — | 10 | 9 Months | |
| 14.6 | 12a | 25 | — | 10 | — | — | 10 | — | 5 | 6 Months | |
| 14.7 | 12c | 20 | 10 | 10 | — | — | — | — | — | 9 Months | |
| 14.8 | 12b | 30 | — | — | — | 15 | 10 | 5 | — | 6 Months | |

TABLE XII

| Ex. No. | Additive solution No. | Total Additive Conc. in PPM based on initial crude charge rate | Quills where added 1 | 2 | 3 | 4 | 5 | 6 | 7 | Total Time additive so added at each quill | Fouling results |
|---|---|---|---|---|---|---|---|---|---|---|---|
| 15.1 | 12a | 30 | — | 30 | — | — | — | — | — | 6 Months | FOULING REDUCED |
| 15.2 | 12b | 20 | 10 | 10 | — | — | — | — | — | 9 Months | |
| 15.3 | 12c | 10 | — | — | — | — | — | — | 10 | 9 Months | |
| 15.4 | 12c | 50 | 10 | 10 | 10 | — | 10 | 10 | — | 9 Months | |
| 15.5 | 12b | 30 | — | — | — | 15 | — | 15 | — | 6 Months | |
| 15.6 | 12a | 25 | — | — | 10 | — | 15 | — | — | 6 Months | |
| 15.7 | 12b | 15 | — | — | — | — | 15 | — | — | 9 Months | |
| 15.8 | 12c | 25 | 10 | — | — | — | — | — | 15 | 6 Months | |

The claims are:

1. In a method for reducing fouling of surfaces contacted with crude oils and residual crude oils during refinery processing thereof, said refinery processing comprising a successive series of continuously practiced steps including:

A. heating a crude oil in a heat exchanger to a temperature in the range from about 100° to 200° F., B. desalting said crude oil by the substeps of 1. turbulently mixing with the so heated crude oil from about 3 to 8 parts by weight of water for each 100 parts by weight of said crude oil,
2. breaking said emulsion, and
3. separating the resulting aqueous phase from the resulting crude oil phase, C. further heating said resulting crude oil in a post desalter heat exchanger to a temperature in the range from about 200° to 500° F., D. still further heating said resulting crude oil in a furnace to a temperature in the range from about 500° to 700° F., E. fractionally distilling in an atmospheric still, the so heated, crude oil at temperatures ranging from about 300° to 650° F. and at pressures ranging from and including atmospheric up to about 50 psia. and condensing the distillates until an atmospheric residue remains which boils above a temperature in the range from about 300° to 650° F., F. heating said atmospheric residue in a furnace to a temperature in the range from about 650° to 800° F while maintaining subatmospheric pressure of from about 5 to 14 p.s.i.a., G. fractionally distilling in a vacuum still the so heated atmospheric residue at temperatures ranging from about 800° to 1000° F, under subatmospheric pressure of from about 1 to 5 to p.s.i.a. and condensing the distillates until a viscous pitch results which boils above a temperature in the range from about 1000° to 1500° F, H. heating said viscous pitch in a furnace to a temperature in the range from about 1000° to 1500° F at subatmospheric pressures of from about 1 to 5 p.s.i.a. and I. passing said so heated pitch into a flash zone maintained at a temperature in the range from about 860° to 900° F at pressures ranging from about 50 to 350 p.s.i.g., the improvement which comprises the steps of:

a. admixing with at least one material selected from the group consisting of said crude oil, said atmospheric residue, and said viscous pitch a small amount of at least one additive preceding at least one of the respective and processing steps in said series designated above as (A) through (I), and thereafter b. subjecting such resulting mixture to the remaining successive processing step(s) in said series, said additive being at least one compound selected from the group consisting of phosphate esters and phosphite esters, said phosphate esters being characterized by the general formula

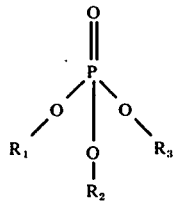

where:

$R_1$, $R_2$, and $R_3$ are each independently selected from the group consisting of hydrogen, an addition complex of hydrogen with an amine, alkyl, aryl, alkaryl, cycloalkyl, alkenyl, and aralkyl, provided that in any given such phosphate ester at least one and not more than two of each of $R_1$, $R_2$ and $R_3$ are each hydrogen or an addition complex of hydrogen with an amine, and said phosphite esters being characterized by the general formula

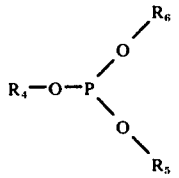

where:

$R_4$, $R_5$ and $R_6$ are each independently selected from the group consisting of hydrogen, an addition complex of hydrogen with an amine, alkly, aryl, alkaryl, cycloalkyl, alkenyl, and aralkyl, provided that in any given such phosphite ester at least one and not more than two of each of $R_4$, $R_5$, and $R_6$ are each hydrogen or an addition complex of hydrogen with an amine.

2. The process of claim 1 wherein said surfaces so contacted are preliminarily fouled with deposits from crude oil material during refinery processing thereof.

3. The process of claim 1 wherein said additive is first dissolved in a heavy aromatic hydrocarbon having a boiling point in the range from about 350° to 550° F before being admixed with said material.

4. The process of claim 1 wherein said additive is so admixed preceding at least two of said respective processing steps.

5. The process of claim 5 wherein said additive is simultaneously so admixed preceding at least steps (A), (C), (F), and (H).

6. The process of claim 1 wherein from about 2 to 50 parts per million of said additive (total additive weight basis) are admixed with said material.

7. The process of claim 1 wherein, in each such phosphate compound, $R_1$ and $R_2$ are each lower alkyl, and $R_3$ is a hydrogen addition complex with an amine.

8. The process of claim 1 wherein, in each such phosphite compound, $R_4$ and $R_5$ are each lower alkyl, and $R_6$ is hydrogen.

9. The process of claim 1 wherein at least one of said phosphate esters is so admixed in combination with at least one of said phosphite esters.

10. The process of claim 1 wherein said phosphate compound is either mixed octyl phosphate amine salt or a mixed butyl phosphate amine salt.

11. The process of claim 1 wherein said additive is initially continuously admixed at a rate of from about 2 to 50 parts per million and, then, thereafter, following a period of such admixture of at least about 1 week, said additive is continuously admixed at a rate of from about 5 to 20 parts per million for a period in excess of 1 week.

* * * * *